US011226178B1

(12) United States Patent
Goepfert

(10) Patent No.: US 11,226,178 B1
(45) Date of Patent: Jan. 18, 2022

(54) ARMOR USING SHEAR-THICKENING FLUID

(71) Applicant: John R. Goepfert, Janesville, WI (US)

(72) Inventor: John R. Goepfert, Janesville, WI (US)

( * ) Notice: Subject to any disclaimer, the term of this patent is extended or adjusted under 35 U.S.C. 154(b) by 581 days.

(21) Appl. No.: 15/672,787

(22) Filed: Aug. 9, 2017

Related U.S. Application Data

(60) Provisional application No. 62/372,968, filed on Aug. 10, 2016.

(51) Int. Cl.
*F41H 5/04* (2006.01)
*F41H 5/007* (2006.01)

(52) U.S. Cl.
CPC ..... *F41H 5/007* (2013.01)

(58) Field of Classification Search
CPC ..... F41H 1/02; F41H 5/0471; F41H 5/0478; F41H 5/08; F41H 5/023; F41H 5/013; F41H 5/04; F41H 5/0414; F41H 5/0421; F41H 5/0464; F41H 7/04; B32B 18/00; B32B 2571/02; B32B 2250/00; B32B 2250/40; B32B 2250/42; B32B 2264/10; B32B 2307/558
See application file for complete search history.

(56) References Cited

U.S. PATENT DOCUMENTS 3,649,426 A * 3/1972 Gates ..... E04B 1/62 428/68
2007/0293107 A1* 12/2007 Folio ..... B32B 3/12 442/134
2012/0174748 A1* 7/2012 Landi ..... F41H 1/02 89/36.02

* cited by examiner

*Primary Examiner* — Yan Lan
(74) *Attorney, Agent, or Firm* — Craig A. Fieschko, Esq.; DeWitt LLP

(57) ABSTRACT

Armor for protection against projectiles, shrapnel, blades, and other penetrants has an inner container subdivided into cells, with the cells being filled with a slurry made of dilatant (shear-thickening fluid) and hard particles. The opposing outer surfaces of the container are shielded by ballistic fabric layers and hard outer plates, with the container, fabric layers, and plates then preferably being bound together by an outer envelope. The various layers of the armor cooperate to provide high protection against penetrants, while at the same time providing lightweight and easily repairable armor suitable for cladding of personnel, vehicles, buildings, and other structures.

20 Claims, 1 Drawing Sheet

ARMOR USING SHEAR-THICKENING FLUID

CROSS-REFERENCE TO RELATED APPLICATIONS

This application claims priority under 35 USC § 119(e) to U.S. Provisional Patent Application 62/372,968 filed Aug. 10, 2016, the entirety of which is incorporated by reference herein.

FIELD OF THE INVENTION

This document concerns an invention relating generally to armor for personnel, vehicles, and buildings, and more specifically to armor using non-Newtonian shear-thickening fluids, also known as dilatants.

SUMMARY OF THE INVENTION

The invention involves armor formed of one or more containers configured to cover an area to be protected, e.g., as one or more plates extending across an area to be protected, with the containers containing a non-Newtonian shear-thickening fluid (a dilatant). Preferably, the dilatant has hard particles suspended therein, and is itself suspended within a cellular divider structure, with the divider structure preferably being at least partially enclosed within or bounded by a liner inside the container. One or more plates, preferably on the outer face of the container(s), can also be provided as an outer layer of protection. A container of this nature, or several adjacently situated containers, can be configured to cover and protect portions of the body or other matter to be protected. Such containers protect against bullets, flak/shrapnel, and other high velocity projectiles by utilizing the tendency of a dilatant to instantaneously "harden" upon application of force, in conjunction with the hard particles' tendency to interfere with the passage of projectiles, absorb their kinetic energy, and break them into fragments. These behaviors also provide protection against knives and puncturing/slashing weapons, which are largely deterred by the outer plate(s).

Armor of this nature is advantageously lighter, and less fragile, than ceramic plate armor, it disperses impact energy such that projectiles, blades, and other penetrants typically will not achieve full penetration (and such that a wearer will often not feel the penetrant's impact); it eliminates (or at least reduces) armor spall/shrapnel, whereby armor fragments do not (or minimally) disperse upon impact from penetrants; it can maintain its effectiveness after multiple impacts; it can be repaired in the field with a syringe of dilatant and a patch (e.g., a carbon fiber fabric patch); it can be made to be neutrally (or even positively) buoyant, which is beneficial for amphibious uses; and it can be made to be both inflammable and nonconductive.

DETAILED DESCRIPTION OF EXEMPLARY VERSIONS OF THE INVENTION

The following definitions of certain terminology used throughout this document will assist the reader's understanding of the following discussion.

A "penetrant" refers to a projectile (bullets, flechettes, arrows, etc.), blade, fragments or bullets or blades (shrapnel, etc.), or other matter (e.g., armor fragments) that may cause damage to a body, vehicle, building, or other matter to be protected by the armor.

A "ballistic fabric" is a fabric known to be used in anti-projectile and/or anti-shrapnel/flak applications, typically containing fibers of one or more of Kevlar or Twaron (aramids), Dyneema or Spectra (ultra-high-molecular-weight polyethylenes), Zylon (polyoxazole), and ballistic nylon. Ballistic fabrics may be woven, knit, or may have their fibers held arrayed into a fabric by other means (as in Spectra Shield fabric, wherein Spectra fibers are bonded by a polymer resin).

The "major dimension" of an object is the greatest distance between opposing sides of the object, as measured through an axis extending through the geometric center of the object. Conversely, the "minor dimension" of an object is the least distance between opposing sides of the object, as measured through an axis extending through the geometric center of the object. The terms "dimension" and "diameter" can be regarded as generally interchangeable, with "diameter" being preferred for objects, voids, or cross-sections with a more circular or spherical shape.

Where the terms "substantially," "primarily," and the like are used, these should be regarded as meaning "in major part." For example, an object formed substantially or primarily of a substance has over half of its volume formed of the substance.

Where a measurement or other value is qualified by the term "about" or "approximately" (for example, "about 50 cm"), this can be regarded as referring to a variation of 10% from the noted value. Thus, "about 50 cm" can be understood to mean between 45 and 55 cm.

It should be understood that various terms referring to orientation and position used throughout this document—e.g., "upper" and "lower" (as in "upper container section" and "lower container section")—are relative terms rather than absolute ones. In other words, it should be understood (for example) that a "lower container section" of armor may in fact be located at the top of the armor (or elsewhere) depending on the overall orientation of the armor. Thus, such terms should be regarded as words of convenience, rather than limiting terms.

Figure 1:
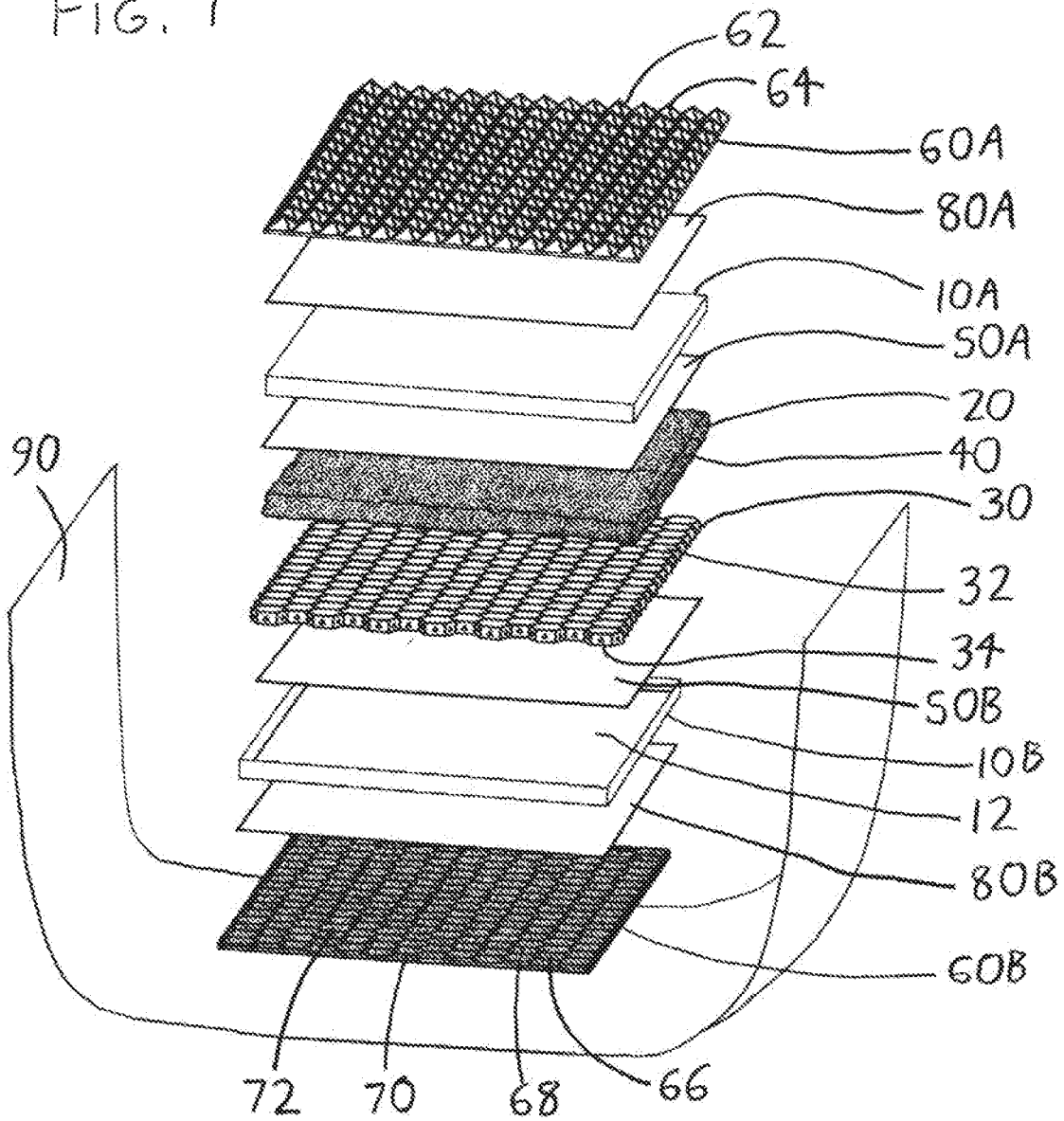
FIG. 1 is an exploded (disassembled) view of an exemplary version of armor in accordance with the invention.
Figure 2:
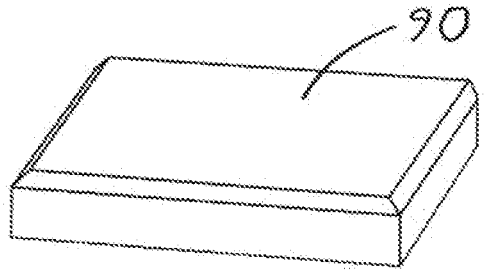
FIG. 2 is an assembled/completed view of the armor of FIG. 1.

Looking to the accompanying FIGS. 1 and 2, which show an exemplary armor plate in exploded (disassembled) form (FIG. 1) and in completed (assembled) form (FIG. 2), the armor includes a container (shown in sections 10A and 10B in FIG. 1) configured to at least substantially enclose an internal container volume 12; dilatant (shear-thickening fluid) 20, depicted as a mass of fluid in FIG. 1, which at least substantially fills the container volume 12; a divider structure 30 within the container volume 12 (and within the dilatant 20), wherein the divider structure 30 defines cells 32 within the container volume 12, with the cells 32 having the dilatant 20 therein; particles 40 dispersed within the dilatant 20; liners 50A/50B situated between the container 10A/10B and the divider structure 30; first and second plates 60A/60B situated on opposite sides of the container 10A/10B; a fabric layer 80A/80B situated between each plate 60A/60B and the container 10A/10B; and an outer envelope 90 wherein the container 10A/10B, plates 60A/60B, and fabric layers 80A/80B are at least substantially enclosed. Each of these components will now be discussed in turn.

The container 10A/10B can take any form suitable for containing the divider structure 30 and dilatant 20 (and any particles 40 therein), and for shielding the area to be protected by the armor. In FIG. 1, the container 10A/10B is depicted as a rigid box whose lower (inner armor side) container section 10B is sized to complementarily receive the divider structure 30 therein, and an upper (outer armor side) container section 10A which them fits over the lower container section 10B. The container 10A/10B has a thickness defined in the direction oriented generally perpendicular to the area to be protected (here defined by the minor dimensions of the container 10A/10B), and a length and width (armor coverage area) defined in the directions oriented generally parallel to the area to be protected. The thickness is preferably less than the length and width, such that the container 10A/10B is plate-like. In the illustrated form, the container 10A/10B may be formed of any suitable rigid materials, such as a fiber/resin composite (e.g., carbon fiber or fiberglass), polymer, metal, ceramic, or combination of these materials, with a lighter-weight option such as composite or polymer being preferred. However, the container 10A/10B could instead be provided in the form of a flexible bag or wrap made of fabric (preferably ballistic fabric), polymer, or other materials, which may be impregnated with a thermosetting resin or other hardening material if the flexible container might otherwise permit leakage of dilatant 20 (e.g., if the cells 32 of the divider structure 30 are open and the liners 50A/50B are not present). Additionally, the contour of the coverage area is preferably such that it substantially conforms to the area to be covered. The container 10A/10B need not assume a plate-like form as depicted in FIG. 1, and can have a contour over its coverage area such that it substantially conforms to the area to be covered and protected; for example, it might be shaped like a breastplate or helmet. In any event, the divider structure 30, liners 50A/50B, and other components are preferably complementarily shaped to fit within or about the container 10A/10B. The container 10A/10B may also be formed in more or less than two parts, and it need not completely enclose the divider structure 30 in a liquid-tight fashion if the divider structure 30 and/or liners 50A/50B are sufficient to prevent leakage of dilatant 20 from the container 10A/10B, and/or if the structure or usage of the container 10A/10B are such that dilatant leakage is unlikely to occur. The container 10A/10B may be closed/sealed in any appropriate manner, e.g., via a friction-fit or other inter-part engagement, adhesive, solder, wrapping within a polymer-impregnated fabric, or via other means.

The dilatant 20 is a non-Newtonian shear-thickening fluid, that is, its viscosity increases as it experiences greater shear. Thus, when pierced by a penetrant (particularly a ballistic penetrant), it becomes thicker, more resistant to piercing, and it spreads impact forces over a greater area, diminishing the effect of impact. While any dilatant 20 may be used, it is preferably one which exhibits high viscosity increase as shear rate increases. A common dilatant suitable for use in the invention is PEG-400 (i.e., polyethylene glycol). Stabilizers and other additives may be added to the dilatant 20 where needed, e.g., antioxidants may be added to the dilatant 20 for high-temperature stability.

The divider structure 30 preferably confines the dilatant 20 within a series of closed or partially closed cells 32 within the container volume 12. The division of the container's interior into multiple smaller cells 32 containing dilatant 20 is believed to enhance the shear encountered by the dilatant 20 within a cell 32 in response to the entrance of a fast-moving penetrant, and thus enhance the dilatant's resistance to passage of the penetrant. Additionally, dividing the container volume 12 into cells 32 helps prevent more significant loss of dilatant 20 (and diminished armor effectiveness) in the event the container 10A/10B is penetrated. The divider structure 30 may conveniently and inexpensively be provided as a lattice/mesh sized to be closely received within the container 10A/10B when inserted therein, and which defines cells 32 arrayed in a repeating pattern across the divider structure 30, for example, a repeating hexagonal, square, triangular, or other polygonal pattern. However, the divider structure 30 can instead be integrally formed with the container 10A/10B, and/or can have cells 32 of nonrepeating and/or varying shapes and sizes. The number, size, and configuration of the cells 32 is chosen to optimize the effectiveness of the container 10A/10B, divider structure 30, and dilatant 20 for stopping penetrants of the types most likely to be encountered by the armor, and this may require simulations and/or experimentation to testy different cell arrangements with different penetrants. As illustrated, the divider structure 30 may be provided by commonly available plastic or aluminum "honeycomb" lattice, having cells 32 with axes perpendicular to the coverage area of the container 10A/10B, and having open opposing ends situated along these axes. Other alignments could be used (for example, the cell axes could be parallel to the coverage area, rather than perpendicular), or different alignments could be used in the same divider structure 30 (for example, with some cells 32 being aligned parallel with one axis and other cells 32 being aligned along other axes), or no alignment may be apparent where cells 32 have no apparent axis. Stacking cells 32 in "echelon" or "cascading" fashion, such that penetration of a first (outer layer) cell 32 causes thickening of the dilatant 20 therein, which then urges against two or more second (inner layer) cells 32, which then in turn urge against still more third (further inner) cells 32, may enhance the armor's effectiveness, but such an arrangement may require that the divider structure 30 be formed in multiple parts or layers, with different parts/layers being installed within the container 10A/10B after prior parts/layers have been filled with dilatant 20 and installed. As this arrangement implies, the cells 32 of divider structures 30 may be filled with dilatant 20 and then closed (as by "capping" or "plugging" them, perhaps by adhering or otherwise installing another part/layer of the divider structure 30).

Preferably, the divider structure 30 includes passages 34 extending between at least some of the cells 32, whereby dilatant 20 may flow between cells 32 through the passages 34. Thus, when a penetrant enters one cell, the resulting pressure wave in the cell's dilatant 20 may propagate to adjacent connected cells 32 and assist with dispersing impact forces across the coverage area of the container 10A/10B. The size, placement, and configuration of the passages 34 with respect to their cells 32 can enhance shear within the dilatant 20, and thus enhance impact dispersion. Preferably, the passages 34 are small in comparison to their cells 32, such that each passage has a major (maximum) diameter which is less than half of the minor dimension of any cell upon which the passage opens. However, this preference may not be implemented, or may be difficult to discern in divider structures 30 where the cells 32 are not well-defined as individual chambers, and where passages 34 between chambers are not readily visible as distinct openings in chamber walls. As an example, cells 32 and passages 34 might be effectively provided by spaced baffles extending between opposing walls, with the baffles defining cell walls and the spaces therebetween defining passages 34.

While not shown in the accompanying drawings, cells 32 may also include structures that enhance shear in response to a pressure wave propagating through the dilatant 20, such as protrusions or "teeth" arrayed along the walls of cells 32 between the front and rear of the armor, and/or arrayed about the circumferences of the passages 34.

Particles 40 are preferably included in the dilatant 20, as these are believed to interfere with the passage of penetrants, receive their force, and increase shear (and thus further increase dilatant viscosity and penetrant deterrence). The particles 40 are hard, preferably having a Mohs hardness of 4 or greater (that is, at least as great as iron), and can be made of metals, ceramics, polymers, and/or other materials, with silicon carbide (Mohs hardness of approximately 9) being suitable. Boron carbide may also or alternatively be used to provide at least some degree of radiation protection. The dilatant 20 and particles 40 are preferably chosen such that the dilatant 20 will maintain the particles 40 in suspension over the range of operating temperatures in which the armor is intended for use, and thus the particles 40 may be coated/encapsulated in polymers or other materials to appropriately adapt their density with respect to the dilatant 20. It is preferred that the particles 40 have a major dimension which is less than half of the minor dimension of the cell(s) in which they are situated. More preferably, the particles 40 are smaller, and have average sizes in the range of 1,200 grit (0.0038 mm mean particle diameter) to 5 grit (4 mm mean particle diameter), with 1,000 grit (0.0058 mm mean particle diameter) to 16 grit (1.18 mm mean particle diameter) being preferred. Most preferably, mixtures of particles 40 having different particle sizes within these ranges are used.

One or more liners 50A/50B may be included to retain dilatant 20 within an open-celled divider structure 30 (in the manner of gaskets), and/or to slow and/or capture any penetrants (and/or fragments thereof) that exit the dilatant-filled divider structure 30. Each liner 50A/50B is preferably formed of one or more sheets of, or an envelope or bag of, one or more layers of ballistic fabric, preferably impregnated with polymer or epoxy to prevent the dilatant 20 from seeping into or through the fabric.

One or more outer plates 60A/60B may be situated outside the container 10A/10B, with each outer plate 60A/60B having a major surface oriented at least substantially parallel to an outer surface of the container 10A/10B, to further assist with thwarting penetrants. In FIG. 1, a first outer plate 60A is situated adjacent to the upper (outer armor side) container section 10A, and a second outer plate 60B is situated adjacent to the lower (inner armor side) container section 10B. The first outer plate 60A is shown with a discontinuous outer (upper) surface 62 defined by an array of pyramidal bumps 64, and a continuous (here planar) inner surface—which is not visible in the drawings, but which resembles the inner surface 66 of the second outer plate 60B—configured to complementarily abut the container section 10A and any intermediate fabric layer 80A. The second outer plate 60B is intended to serve as a final barrier to penetrants adjacent the inner face of the container 10A/10B, and it has the continuous planar inner surface 66 configured to complementarily abut the container section 10B and any intermediate fabric layer 80B, and an outer surface (not shown) which may be configured to conform to any surface which the inner face of the armor will abut. The first and second outer plates 60A/60B of FIG. 1 have similar construction, with both being formed of a polymer (e.g., thermosetting resin) matrix 68 having embedded particles 70 (e.g., silicon carbide particles), and also having an embedded lattice 72 extending parallel to the major surface of the outer plate 60A/60B (this lattice 72 being visible in the second outer plate 60 as a hexagonal mesh, e.g., an aluminum "honeycomb" lattice with inter-cell passages resembling that used for the divider structure 30). The particles 70 may have a hardness and size similar to those used in the dilatant 20, e.g., a Mohs hardness of 4 or greater, and a grit size of 1,200 grit or larger. However, the plates 60A/60B may be formed of materials other than a particle-laden polymer matrix, including materials used in known ceramic, composite, or metal armor, and may have different configurations (e.g., thicknesses and/or surface structures), to meet particular threat levels, weight requirements, etc.

The first outer plate 60A (if included) is particularly intended to serve as an outer layer of protection for the container 10A/10B, and to arrest or slow low-speed penetrants (in particular blades). Its discontinuous outer surface 62 is believed to slow and abrade/deform projectiles, increasing their effective surface area and enhancing their shear when entering the dilatant 20 within the container 10A/10B, and thereby increasing the dilatant's resistance to the projectile's passage. If present, the discontinuous outer surface 62 need not be defined by an array of pyramids 64, for example, it could be provided by an array of protrusions of any shape (bumps/knobs, ridges/corrugations, etc.).

The second outer plate 60B (if included) is intended to serve as a final barrier to penetrants, and it need not be configured similarly to the first outer plate 60A; for example, it could simply take the form of a metal plate which acts synergistically with any adjacent fabric layer(s) 80B situated between the second outer plate 60B and the container 10A/10B, in that the plate 60B can receive and spread the impact of any penetrants which reach the adjacent fabric layer 80B. (The upper container section 10A in FIG. 1 can similarly cooperate with any adjacent fabric layer 80A.) As examples, the second outer plate 60B might be formed of hard-coated aluminum or titanium (these materials being chosen for their light weight, with other materials being possible).

Any fabric layers 80A/80B provided between the outer plate(s) 60A/60B and the container 10A/10B are preferably formed of multiple layers/sheets of ballistic fabric. As noted above, a fabric layer 80A/80B can cooperate with any adjacent rigid surface (such as the outer face of container section 10A, the inner face of the second outer plate 60B, etc.) to disperse impact forces across the area of the rigid surface.

The outer envelope 90 serves to bind the foregoing components into a unit (as seen in FIG. 2), and is preferably formed of a fabric (e.g., woven carbon fiber), or simply fibers, impregnated with a polymer (e.g., a thermosetting resin) and wrapped about at least a substantial portion of the outer exposed area of the container 10A/10B, plates 60A/60B, and fabric layers 80A/80B. Alternatively, the outer envelope 90 may be formed of a polymer-impregnated fabric/fiber bag or sleeve which (preferably) closely receives the container 10A/10B, plates 60A/60B, and fabric layers 80A/80B. Some of these components may be joined as a unit by an inner envelope before the remaining components are added and joined by the outer envelope 90; for example, the container 10A/10B may be enclosed within an inner envelope prior to adding the fabric layers 80A/80B and plates 60A/60B, and the entire assembly may then be sealed within an outer envelope 90. Adhesive or other forms of attachment may be used to attach the container 10A/10B, plates 60A/60B, and fabric layers 80A/80B instead of, or in addition to, the envelope 90, but it is preferred that the coverage areas of these components not be adhered together, as the armor's ability to resist penetrants may be enhanced when these components act as independent layers.

Save for the container 10A/10B and the dilatant 20, the remaining components are optional, and/or can be provided in different combinations. As examples, the container 10A/10B may contain particle-filled dilatant 20, without use of a divider structure 30; or the container 10A/10B may contain particle-free dilatant 20 within a divider structure 30; liners 50A/50B need not be present on one or both sides of the divider structure 30 (particularly if the divider structure 30 is integrally formed with, or closely fit within, the container 10A/10B); one or both of the first and second plates 60A/60B may be absent, as may be the fabric 80A/80B between a plate 60A/60B and the container 10A/10B (and plates 60A/60B may be provided without fabric 80A/80B, and likewise fabric 80A/80B may be provided without plates 60A/60B); plates 60A/60B may be provided within the container 10A/10B rather than outside it (though external placement is preferred to deter penetration of the container); and the outer envelope 90 may be wholly or partially eliminated, with the components therein instead being maintained as a unit by other binding means for holding the components together, such as adhesives, adhesive tape, clamps/clips, etc. It is preferred that any binding means do not penetrate the container 10A/10B, plates 60A/60B, fabric 80A/80B, envelope 90, and/or any other components included within the armor, for example, screws/bolts or other fasteners extending through the components are not preferred.

Moreover, components may be duplicated: multiple dilatant-containing containers 10A/10B may be stacked (with fabric 80A/80B and/or plates 60A/60B between or about the containers 10A/10B); a container 10A/10B may contain multiple layers of divider structures 30 (and liners 50A/50B), possibly with cells 32 of different sizes, configurations, and/or orientations; multiple plates 60A/60B and/or fabric layers 80A/80B may be provided on one or both sides of a container 10A/10B (and may be stacked in different orders, and/or interleaved); and multiple envelopes 90 may be provided about a container 10A/10B, for example, with a first envelope being situated about the container 10A/10B and the first plate 60A, and a second envelope then containing this arrangement along with the second plate 60B.

Components may likewise be combined. As noted previously, the divider structure 30 can be integrally formed as part of the container 10A/10B. As another example, the lattice of one of the outer plates 60A/60B could protrude from its surface to define the divider structure 30 and the cells 32 therein, which may be filled with dilatant 20 and particles 40, and the other of the outer plates 60A/60B might then be affixed atop this divider structure, such that the outer plates 60A/60B also define the container 10A/10B.

All components may be formed of any suitable materials, including metals, plastics, ceramics, and/or composites, unless the nature or function of a component implies that suitable materials are more limited—for example, the dilatant 20 must be a shear-thickening fluid.

To further illustrate possible configurations for the armor, following are several exemplary constructions.

Example: General Dilatant/Particle Slurry

72% (by volume) PEG 400
28% Fumed Silica
Optional: Up to 3% antioxidant

Example: "Heavy" Dilatant/Particle Slurry

36% (by volume) PEG 400
64% Green Carbide Silica (24 grit)

Example: "Light" Dilatant/Particle Slurry

83% (by volume) PEG 400
17% Green Carbide Silica (1000 grit)

Example: General Armor

A carbon fiber container resembling that of FIG. 1 is used.

An aluminum "honeycomb" lattice with inter-cell passages, as in FIG. 1, is used for the divider structure.

The divider structure is placed in the lower container section, which is then filled with "heavy" slurry. Any remaining voids are filled with "light" slurry.

The top of the filled divider structure is covered with a ballistic fabric liner.

The upper container section is installed over the lower container section.

The closed container is wrapped in polymer-impregnated carbon fiber, which is then cured/dried.

A first outer plate having a discontinuous outer (upper) surface defined by an array of tetrahedral bumps is situated atop the container, with the bumps facing outwardly.

The plate and container are wrapped in polymer-impregnated carbon fiber, which is then cured/dried.

Fabric layers, e.g., 12 sheets of Spectra Shield and 12 layers of Kevlar 29 or 129, are then placed below the plate and container, followed by a 3 mm thick hard-anodized aluminum or titanium second outer plate.

The plates, container, and fabric layers are wrapped in polymer-impregnated carbon fiber, which is then cured/dried.

Example: Reduced Weight Armor

A carbon fiber container resembling that of FIG. 1 is used.

A divider structure defined by an aluminum "honeycomb" lattice with inter-cell passages, as in FIG. 1 but having approximately half of the height of the container's interior, is placed in the lower container section, which is then filled with "heavy" slurry.

The top of the filled divider structure is covered with a ballistic fabric liner.

Another half-height divider structure is placed in the lower container section atop the liner, and is filled with "light" slurry.

The top of the filled divider structure is covered with a ballistic fabric liner.

The upper container section is installed over the lower container section.

The closed container is wrapped in polymer-impregnated carbon fiber, which is then cured/dried.

A first outer plate having a discontinuous outer (upper) surface defined by an array of pyramidal bumps is situated atop the container, with the bumps facing outwardly.

The plate and container are wrapped in polymer-impregnated carbon fiber, which is then cured/dried.

Fabric layers, e.g., 12 sheets of Spectra Shield and 18 layers of Kevlar 129, are then placed below the plate and container, followed by a 3 mm thick hard-anodized aluminum or titanium second outer plate.

The plates, container, and fabric layers are wrapped in polymer-impregnated carbon fiber, which is then cured/dried.

Example: Shrapnel-Resistant Armor

A carbon fiber container resembling that of FIG. 1 is used.
A divider structure defined by an aluminum "honeycomb" lattice with inter-cell passages, as in FIG. 1 but having approximately one-quarter of the height of the container's interior, is placed in the lower container section, which is then filled with "heavy" slurry.
The top of the filled divider structure is covered with a ballistic fabric liner.
Another quarter-height divider structure is placed in the lower container section atop the liner, and is filled with "light" slurry.
The top of the filled divider structure is covered with a ballistic fabric liner.
Another quarter-height divider structure is placed in the lower container section atop the liner, and is filled with "heavy" slurry.
The top of the filled divider structure is covered with a ballistic fabric liner.
Another quarter-height divider structure is placed in the lower container section atop the liner, and is filled with "light" slurry.
The top of the filled divider structure is covered with a ballistic fabric liner.
The upper container section is installed over the lower container section.
The closed container is wrapped in polymer-impregnated carbon fiber, which is then cured/dried.
A first outer plate having a discontinuous outer (upper) surface defined by an array of tetrahedral bumps is situated atop the container, with the bumps facing outwardly.
The plate and container are wrapped in polymer-impregnated carbon fiber, which is then cured/dried.
Fabric layers, e.g., 12 sheets of Spectra Shield and 18 layers of Kevlar 129, are then placed below the plate and container, followed by a 3 mm thick hard-anodized aluminum or titanium second outer plate.
The plates, container, and fabric layers are wrapped in polymer-impregnated carbon fiber, which is then cured/dried.

It should be understood that the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. Armor including:
a. a container configured to at least substantially enclose an internal container volume,
b. a divider structure within the container volume, wherein the divider structure defines cells within the container volume, and
c. dilatant within the cells,
wherein the divider structure includes passages between at least some of the cells, whereby dilatant continuously extends between cells through any passage therebetween, the dilatant being at least substantially static between the cells prior to breach of one of the cells by a penetrant, whereby the dilatant does not substantially flow between cells prior to the breach.

2. The armor of claim 1 wherein the dilatant has particles dispersed therein, the particles being at least partially formed of one or more of:
a. ceramic material,
b. metal material, and
c. polymer material.

3. The armor of claim 2 wherein the particles have:
a. a grit size of 1,200 grit or larger, and
b. a Mohs hardness of 4 or greater.

4. The armor of claim 1 wherein each passage has a major diameter which is less than half of the minor dimension of any cell upon which the passage opens.

5. The armor of claim 1 wherein the cells are arrayed in a repeating pattern across the divider structure.

6. The armor of claim 1 wherein for each passage extending between adjoining cells, the maximum diameter of the passage is no greater than half of the minor dimension of each of the adjoining cells.

7. The armor of claim 1 wherein the dilatant has solid particles dispersed therein, each particle having a major dimension which is less than half of the minor dimension of any cell in which it is situated.

8. The armor of claim 1 further including a gasket situated between the container and the divider structure, wherein the gasket bounds the interior of at least one of the cells of the divider structure.

9. The armor of claim 1 further including an outer envelope wherein the container is at least substantially enclosed.

10. The armor of claim 9 wherein the envelope is at least substantially formed of:
a. fibers, and
b. polymer.

11. The armor of claim 10 further including an outer plate situated:
a. outside the container, and
b. within the envelope.

12. Armor including:
a. a container configured to at least substantially enclose an internal container volume,
b. a divider structure within the container volume, wherein the divider structure defines cells within the container volume,
c. dilatant within the cells,
d. an outer plate having a major surface oriented at least substantially parallel to an outer container surface of the container, the outer plate being formed of:
(1) a polymer matrix,
(2) particles embedded within the matrix, the particles having:
i. a grit size of 1,200 grit or larger, and
ii. a Mohs hardness of 4 or greater, and
(3) a lattice embedded within the matrix, the lattice extending at least substantially parallel to the major surface of the outer plate.

13. The armor of claim 12 further including a fabric layer situated between the outer plate and the container.

14. The armor of claim 12 further two of the outer plate, wherein the container is sandwiched between the two outer plates.

15. The armor of claim 14 further including an outer envelope wherein the outer plates and container are at least substantially enclosed, the outer envelope being at least partially formed of fibers.

16. Armor including:
a. a container configured to at least substantially enclose an internal container volume,
b. dilatant at least substantially filling the container volume,
c. a divider structure within the container volume, wherein the divider structure:

(1) defines cells within the container volume, the cells having the dilatant therein, and (2) the divider structure has passages defined therein between adjacent cells, whereby dilatant situated within the adjacent cells is situated within the passages as well, and wherein the dilatant is at least substantially stagnant within the passages prior to breach of one or more of the cells by a penetrant; and d. an outer plate:

(1) situated adjacent the container, and (2) having a major surface oriented at least substantially parallel to an outer container surface of the container.

17. The armor of claim 16 further including particles dispersed within the dilatant, the particles having:

a. a grit size of 1,200 grit or larger, and b. a Mohs hardness of 4 or greater.

18. The armor of claim 17 wherein:

a. for each passage extending between adjoining cells, the maximum diameter of the passage is no greater than half of the minor dimension of each of the adjoining cells, and b. each particle has a major dimension which is less than half of the minor dimension of any cell in which it is situated.

19. The armor of claim 18 further including a gasket situated between the container and the divider structure, wherein the gasket bounds the interior of at least one of the cells of the divider structure.

20. The armor of claim 19 wherein the outer plate is formed of:

a. a polymer matrix, b. particles embedded within the matrix, the particles having:

(1) a grit size of 1,200 grit or larger, and (2) a Mohs hardness of 4 or greater, and c. a lattice embedded within the matrix, the lattice extending at least substantially parallel to the major surface of the outer plate.

* * * * *